United States Patent [19]

Covil

[11] Patent Number: 4,959,877

[45] Date of Patent: Oct. 2, 1990

[54] ALL-SEASON FLOATING BLANKET

[76] Inventor: Donald M. Covil, P.O. Box 2382, Shallotte, N.C. 28459

[21] Appl. No.: 440,717

[22] Filed: Nov. 24, 1989

[51] Int. Cl.[5] ..... A47C 21/00; A47G 9/00

[52] U.S. Cl. ..... 5/423; 5/505; 62/261

[58] Field of Search ..... 5/423, 421, 482, 469, 5/505, 500, 508; 62/261; 126/205

[56] References Cited

U.S. PATENT DOCUMENTS

| | | | |
|---|---|---|---|
| 2,093,834 | 9/1937 | Gaugler | 5/508 |
| 2,235,966 | 3/1941 | Summers | 5/423 |
| 3,230,556 | 1/1966 | Shippee | 5/423 |
| 3,317,932 | 5/1967 | Gibbons . | |
| 3,327,329 | 6/1967 | Purvis . | |
| 3,680,158 | 8/1972 | Speep . | |
| 3,713,182 | 1/1973 | McNeal . | |
| 3,798,685 | 3/1974 | Hunt et al. . | |
| 4,190,915 | 2/1978 | Birt | 5/505 |
| 4,493,121 | 1/1985 | Williams | 5/505 |
| 4,570,275 | 2/1986 | Merriman | 5/505 |
| 4,572,188 | 2/1986 | Augustine et al. | 62/261 |
| 4,660,388 | 4/1987 | Greene, Jr. | 62/261 |
| 4,777,802 | 10/1988 | Feher | 62/261 |
| 4,802,252 | 2/1989 | Marmor | 5/505 |
| 4,841,589 | 6/1989 | Moore | 5/504 |
| 4,867,230 | 9/1989 | Voss | 5/423 |

*Primary Examiner*—Alexander Grosz

[57] ABSTRACT

Bed covers (20) which can be elevated above a bed (50) solely as a result of differential air pressure. A small blower unit (80) located under the bed (50) supplies air to an air-flow channel network (22) making up the central portion of the bed covers (20). The air-flow channel network (22) is made up of fabric layers which are joined along selective linear alignments (46 and 48) to produce air flow channels (40, 42, and 44). The upper (24) and middle (28) fabric layers are less permeable to air flow than the lower layer (32). The air flows from the blower (80) through a conduit (82) into the air-flow channel network (22), throughout the network (22), and thence through the bottom fabric layer (32). The uniform distribution of air through the bottom layer (32) creates a region of higher pressure under the bed covers (20), thus causing the formation of a cavity (60) between the bed covers (20) and the bed (50).

1 Claim, 3 Drawing Sheets

ALL-SEASON FLOATING BLANKET

BACKGROUND

1. Field of Invention

This invention relates to appliances for beds, specifically to bed covers which are elevated above the bed without the use of structural devices, and to bed covers which control the temperature of beds.

2. Description of Prior Art

Heretofore, patents issued for bed covers in which the bed covers are elevated above the bed, have relied on structural members to support the bed covers. Said patents include, but are not necessarily limited to:

4,841,589 "Bed Cover Support Structure", Mary L. Moore, Mar. 16, 1987

4,802,252 "Bedclothing Support", Adrian Marmor, Apr. 29, 1987

4,644,599 "Bed Cover Lifter"

4,570,275 "Bedding Support", Henry H. Merriman, Oct. 17,1984

4,493,121 "Blanket Lifting Device", Frank Williams, Apr. 28, 1983

4,190,915 "Bed Clothing Support", Isobel J. Birt, Feb. 21, 1978

3,798,685 "Cover Support Assembly", Maureen A. Hunt and Martin J. Criel, Jul. 13, 1972

3,713,182 "Bedclothes Elevator and Bed Warmer", Hugh E. McNeal, May 26, 1971

3,680,158 "Bedding Support Apparatus", Roy A. Speed, May 22, 1970

3,327,329 "Supporting Means for Bed Covers", Cecil Purvis, Jul. 19, 1965

3,317,932 "Bedclothes Support", Micheal J. Gibbons, May 11, 1966.

While these examples of prior art accomplish the function of elevating bed covers above a bed, each suffers from a number of the following disadvantages:

(a) Support framework has to be assembled.

(b) The support framework has to be mechanically attached to the bed.

(c) The support framework includes parts which could lead to mechanical failure.

(d) When the bed is not in use, the support framework must be mechanically retracted, lowered, removed, or otherwise manually adjusted or hidden, to maintain a pleasing appearance of the unused bed.

(e) In cases where air is introduced into the cavity between the bedclothes and the bed, it is supplied through holes, slots, or other openings. These air supply locations are local to the support framework, thus an even distribution of air throughout the cavity is not accomplished.

(f) The size of the cavity cannot be altered.

(g) The location of the cavity is limited to the lower end of the bed.

Likewise, the most common appliance in use for heating beds, the electric blanket, suffers from many of the following disadvantages:

(a) Low-level electromagnetic radiation is emitted from electric blankets, thus creating a health threat.

(b) Folding of the blanket is discouraged.

(c) Sitting on the blanket is discouraged.

(d) The blanket must be handled with care so that induced stresses do not damage the electrical wiring.

(e) The blanket cannot be used during the warmer months.

(f) The blanket exerts weight on the occupant of the bed.

OBJECTS AND ADVANTAGES

Accordingly, several objects and advantages of my invention are:

(a) The blanket can be elevated above the bed without the use of structural support(s).

(b) The blanket has a pleasing appearance when not in use.

(c) No special techiques or procedures are required in making the bed beyond that for conventional blankets and spreads.

(d) The blanket, when placed in operation, distributes air uniformly and gently throughout the cavity thus enhancing comfort.

(e) The blanket can be used year-round by warming the bed in the cooler seasons and cooling the bed in the warmer seasons.

(f) The occupant of the bed can control the lateral extent to which the cavity forms over the body, whether from head to toe or over the lower part of the body.

(g) The occupant of the bed can control the vertical extent to which the cavity forms over the body, whether completely elevated above the body, gently resting on the body, or somewhere in between.

(h) The blanket does not emit electromagnetic radiation (except possibly for the blower which is below the bed at a distance from the occupant of the bed).

(i) The blanket can be handled by pulling, folding, sitting on, or any other way a conventional blanket can be handled.

(j) The blanket can be placed in operation by simply turning a dial, and taken out of operation by turning a dial.

(k) Except for the blower and controls, the blanket has no mechanical parts which could lead to mechanical failure.

Further objects and advantages of my invention will become apparent from a consideration of the drawings and ensuing description of it.

BRIEF DESCRIPTION OF THE DRAWINGS

(NOTE: Though FIGS. 2, 3, and 4 are section views, they are not hatched for purposes of clarity.)

REFERENCE NUMERALS IN THE DRAWINGS

Figure 1:
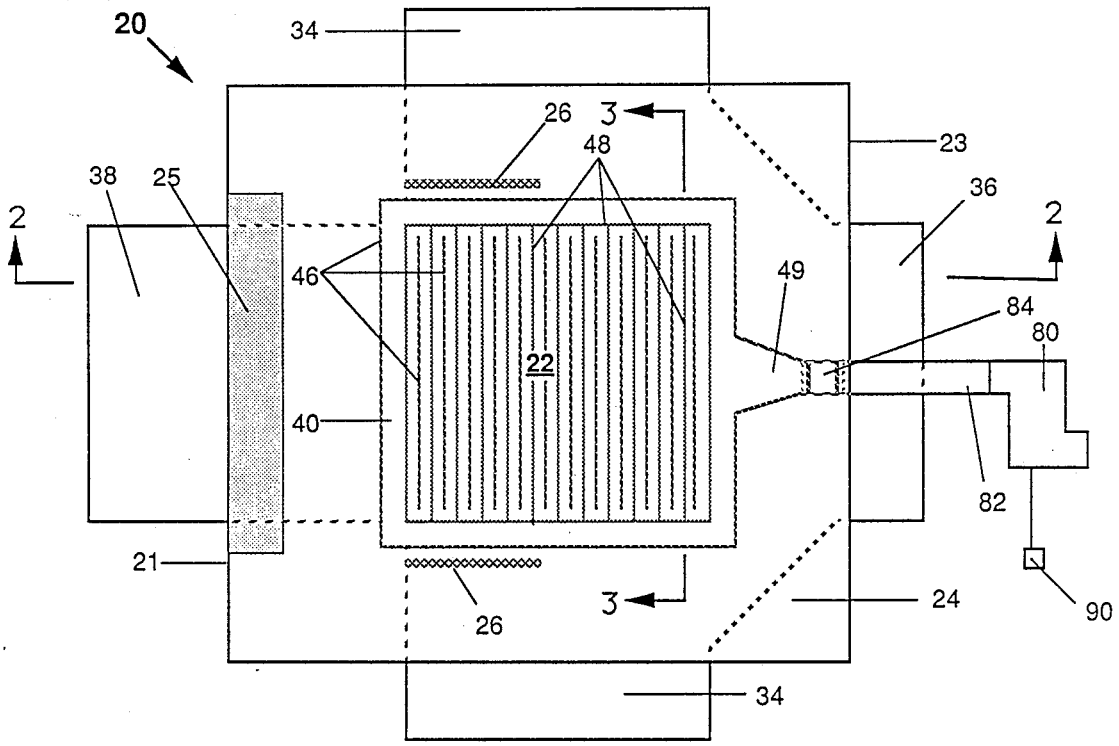
FIG. 1 is a plan view of my invention showing an air-flow channel network and a plurality of fabric layers making up the invention.

20: blanket
21: front edge of blanket
22: air-flow channel network
23: rear edge of blanket
24: upper fabric layer of blanket
25: cotton/polyester portion of upper fabric layer
26: zipper
28: middle fabric layer of blanket
30: orifices in middle fabric layer
32: lower fabric layer of blanket
34: side extension of lower fabric layer
36: rear extension of lower fabric layer
38: front extension of lower fabric layer
40: primary air transport channel
42: secondary air transport channel
44: air distribution channel
46: linear connections between the upper and middle fabric layers
48: linear connections between middle and lower fabric layers
49: entrance to primary air transport channel
50: bed
52: mattress
54: box springs
60: cavity (between blanket and bed)
64: space (outside of blanket)
80: blower
82: air-flow conduit
84: air-flow conduit/fabric adaptor coupling
86: plastic band
90: controls

DESCRIPTION —FIGS. 1, 2, 3, 4, 5, AND 8

FIG. 1 shows a plan view of a basic version of my All-Season Floating Blanket 20 (hereinafter referred to as "blanket"). This view is from the top with the blanket spread out as if on a flat surface. The blanket has a front 21 (toward the head of the bed) and a rear 23 (toward the rear of the bed). Numeral 22 refers to an air-flow channel network (hereinafter referred to as "network") located in the central area of the blanket. The network has a surface area approximately the same size as the surface area of the bed for which it is designed. The network is formed as a part of the blanket by the joining of the three fabric layers along selective linear alignments.

FIGS. 2, 3, 4, and 5, and FIG. 1 to some extent, illustrate that the three fabric layers are an upper layer 24, a middle layer 28, and a lower layer 32. The shaded portion 25 of the upper layer 24 is made of a blend of cotton and polyester, conventional bed sheet material. The remaining and major part of the upper layer is made of a light weight, flexible vinyl material which is relatively impervious to air flow. The middle layer 28 is also made of a material which relatively impervious to air flow such as light weight, flexible vinyl. The bottom layer 32, like the shaded portion of the upper layer, is made of conventional bed sheet material, a blend of cotton and polyester. The lower layer, due to its material makeup, is permeable and air can easily pass through it.

FIGS. 1, 2, 4, and 5 illustrate that the joining of the three fabric layers along selective linear alignments (46 and 48) creates air-flow channels (40, 42, and 44) which make up the network 22. Numeral 46 represents the alignments along which the upper fabric layer 24 is joined to the middle fabric layer 28. The process used for making these connections 46 is adhesive bonding. Numeral 48 represents the alignments along which the middle fabric layer 28 is joined to the lower fabric layer 32. The process for making these connections 48 is sewing.

As a result of the selective joining of the upper 24 and middle 28 fabric layers along the alignments 46, a primary air transport channel 40 is formed around the perimeter of the network 22, and secondary air transport channels 42 are formed to make up part of central area of the network. Also formed as a part of the central area of the network are air distribution channels 44. The air distribution channels are formed by the selective joining of the middle 28 and lower 32 fabric layers along alignments 48. (It is noted that FIG. 1 shows linear alignments 48 to illustrate the locations of these alignments relative to the location of linear alignments 46. Linear alignments 48, however, are below the top surface of the blanket, as illustrated in FIGS. 2 and 4, and cannot actually be seen from a top view).

Figure 3:
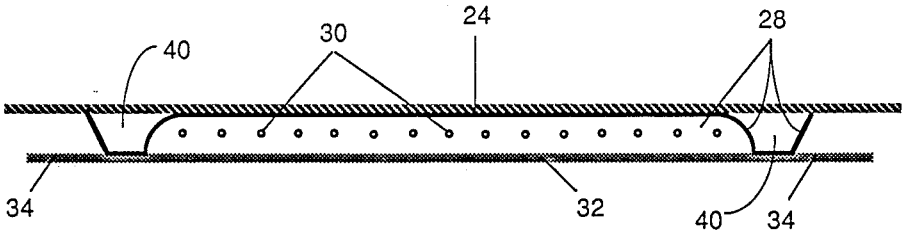
FIG. 3 is a section view taken from FIG. 1 showing principally a representation of the air-flow orifices in the middle fabric layer of the air-flow channel network.
Figure 4:
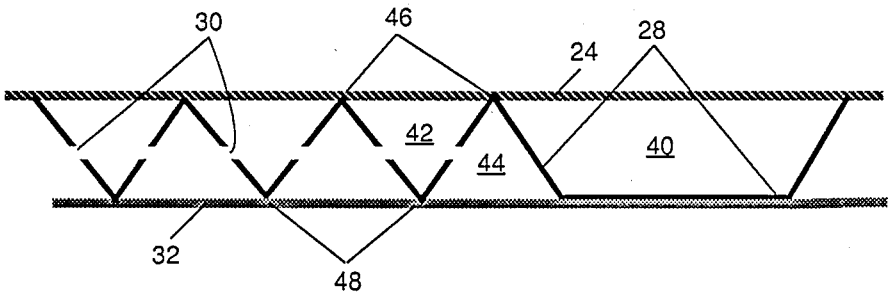
FIG. 4 is a section view of a portion of FIG. 2 illustrating the connection of the three fabric layers in enlarged scale.
Figure 5:
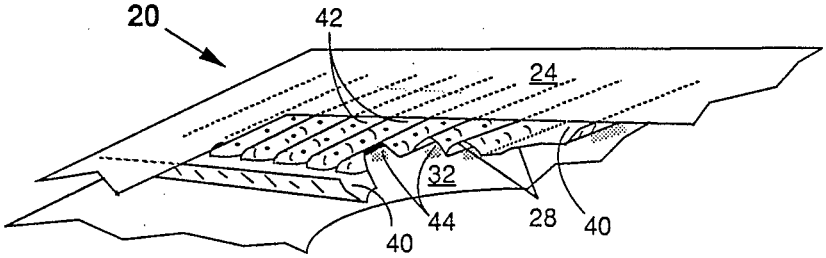
FIG. 5 is a perspective view of my invention with portions of the fabric layers cut away to illustrate the makeup of the air-flow channel network

FIGS. 3 and 4 illustrate orifices 30 located in the middle layer 28. These orifices can vary in size depending on their spacing, the size and weight of the blanket, the air supply flowrate, and other factors. Typical values however are one-eighth to three-sixteenths inches in diameter. They are evenly spaced typically at 2 to 4 inches. These orifices provide openings between the secondary air transport channels 42 and the air distribution channels 44.

Figure 2:
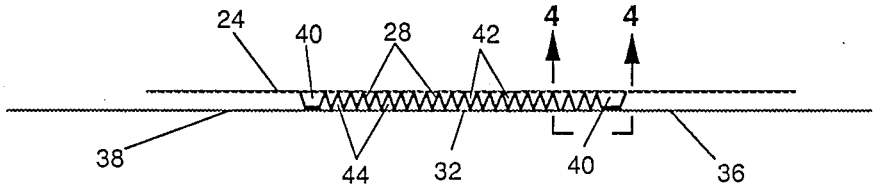
FIG. 2 is a section view taken from FIG. 1 showing three fabric layers connected to form the air-flow channel network.

As shown primarily on FIGS. 1 and 2, the lower fabric layer 32 extends out from each side of the network 22 and out from the rear of the network. The side extensions are referenced by numeral 34, and the rear extension is referenced by numeral 36. Each side extension has a zipper 26 which extends from the front edge of the side extension 34 of the lower layer to a point located 24 to 36 inches from the front edge. The zipper is parallel to the side of the blanket and is located 6 to 8 inches from the edge of the network.

Also shown in FIG. 1 is a front extension 38 of the lower fabric layer 32. The blanket 20 without the fron extension 38 represents one embodiment of the invention, and the blanket 20 with the front extension 38 represents another embodiment of the invention. Neither embodiment is more preferred than the other.

The dimensions of the different parts of the blanket 20 vary depending on the size of the bed for which it is made. Blankets can be made for any of the conventional bed sizes including twin, double, queen, and king. Typical dimensions are given below for the different parts of the blanket.

| Description | Dimension in Inches for: Twin/Double/Queen/King |
|---|---|
| uppper fabric layer 24, front edge to rear edge | 106/106/114/118 |
| uppper fabric layer 24, edge of side to edge side | 74/86/92/100 |
| cotton/polyester portion of upper fabric layer (12 inches × value given) | 42/58/66/86 |
| air-flow channel network 22, front edge to rear edge | 64/66/76/80 |
| air-flow channel network 22, edge of side to edge of side | 38/52/60/68 |
| side extensions of lower fabric layer 34 from edge of network 22 to outer edge of extension | 32/32/32/32 |
| rear extension of lower fabric layer 36 from edge of network 22 | 32/32/32/32 |

-continued

| Description | Dimension in Inches for: Twin/Double/Queen/King |
|---|---|
| to outer edge of extension | |
| width of primary air transport channel 40 | 4/4/5/5 |
| width of secondary air transport channel 42 | 3/3/3/3 |
| width of air distribution channel 44 | 3/3/3/3 |

(It is noted that FIG. 1, to promote clarity of illustration, shows only twelve secondary air transport channels 42 and eleven air distribution channels 44. The actual numbers of air channels, as can be determined by the dimensions presented above, will exceed the number illustrated in FIG. 1.)

Figure 8:
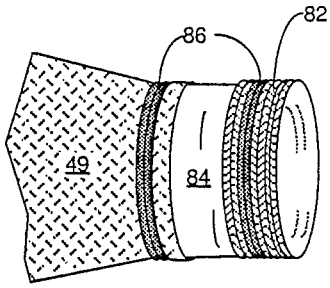
FIG. 8 is a perspective view of one embodiment of an air-flow conduit/fabric adaptor coupling joining the blanket to a conduit used to carry an air supply.

FIGS. 1 shows a small blower 80 which supplies air to the network 22. The blower is variable speed and electrically powered. A flexible conduit 82 from the outlet of the blower is connected to the entrance of the primary air transport channel 49 by a coupling device 84. The coupling device can be made of a rigid material such as plastic or metal. Likewise, the connections of the coupling to the air-flow conduit 82 and the entrance to the primary air transport channel 49 can be made by a number of different methods such as plastic bands, durable "O-ring" rubber bands, or metal straps. The method shown for making the two connections in FIG. 8 makes use of plastic bands 86. The plastic bands are sufficiently tightened to produce a compressive force at the interface of the coupling 84 and conduit 82, and at the interface of the coupling 84 and the entrance of the primary air transport channel 49. The compressive force induces friction between the joined parts to prevent disjointing at either of the two points of connection.

The blower 80 contains a thermostatically controlled induction heater located in its discharge section. Also available as an option for cooling of air would be a miniature air conditioning unit located at the discharge of the blower. An air conditioning unit would not normally be required when the room within which the bed is located is air conditioned. Control of the air supply and temperature is accomplished by operation of dials at a remote control box 90.

OPERATION—FIGS. 1 TO 8

Figure 6:
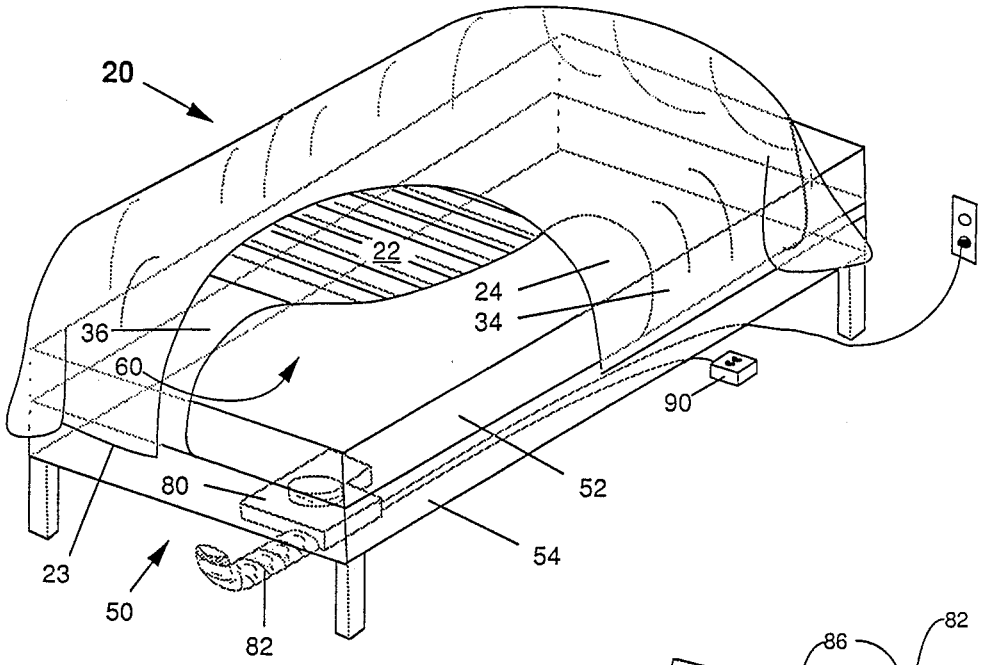
FIG. 6 is a perspective view of a bed with a corner section of the blanket cut away to show one embodiment of my invention in operation.
Figure 7:
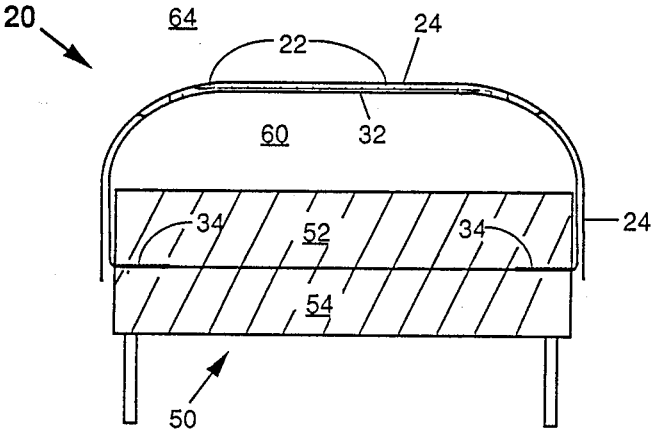
FIG. 7 is a cross section view of a bed showing the blanket in operation, elevated above the bed.

FIGS. 6 and 7 illustrate the All-Season Floating Blanket 20 in operation. These figures show my invention with the blanket elevated above a bed 50. FIG. 6 is perspective view of the bed with a corner section of the blanket cut away. FIG. 7 is a cross section of the bed and blanket. FIGS. 6 and 7 illustrate that the side extensions 34 and the rear extensions 36 of the lower layer are tucked between the mattress 52 and the box springs 54. The position of these extensions between the mattress and box springs provides the primary means for holding the blanket in place while in operation. Not specifically illustrated, due to the similarity with the operation of the side and rear extensions, is the operation of the embodiment of the invention with front extension 38. For this embodiment the front extension 38 would likewise be tucked between the mattress and the box springs, thus creating a totally enclosed cavity within which the occupant(s) lies. For the embodiment without the front extension 38, the front edge of the blanket 21 would rest upon the bed and the upper body (neck and around the shoulders) of the bed's occupant.

FIGS. 6 and 7 each show that the elevated blanket forms a cavity 60 between the blanket and the bed. This condition is accomplished by creating an air pressure within the cavity which is higher than the air pressure of the space 64 outside of the blanket. The magnitude of differential air pressure (difference between air pressure of the cavity 60 and air pressure of the space 64) necessary to elevate the blanket will vary depending on the size and weight of the blanket. It can be easily documented, however, that for every practical weight and size of blanket, the necessary differential air pressure will be less than one hundredth of one pound per square inch (0.01 psi).

The differential air pressure addressed in the paragraph above is accomplished in the following manner:

(a) The blower 80 is turned on.

(b) Air travels through the air-flow conduit 82, the coupling 84, the entrance to the primary air transport channel 49, and into the primary air transport channel 40.

(c) The air, traveling through the primary air transport channel 40, is evenly distributed around the perimeter of the air flow channel network 22.

(d) From the primary air transport channel 40, the airflows into the secondary air transport channels 42.

(e) Once inside the secondary air transport channel 42, the air flows through the orifices 30 in the middle fabric layer 28 into the air distribution channels 44.

(f) Once inside the air distribution channels 44, the continuing supply of air results in constant air flow down through the permeable lower fabric layer 32. This creates a higher air pressure below the blanket than above and outside of it. The differential air pressure results in a net upward force beneath the blanket. The consequence of this upward force is the elevating of the blanket and the formation of the cavity 60.

(g) For the embodiment of the invention where the front extension 38 is not a part, the air exits the cavity 60 primarily through an opening between the front edge of the blanket 21 and the mattress 52. Said opening is formed when an occupant is reclining and his head extends out beyond the front edge of the blanket. Secondary locations of exiting air are at the openings formed at the rear corners of the bed between the side extensions 34 and the rear extension 36 of the lower fabric layer. To lesser degree, air exits through the permeable lower fabric layer extensions 34 and 36. On the other hand, for the embodiment of the invention where the front extension 38 is a part, the occupant's body is totally within the cavity 60. There is consequently no opening between the blanket and the bed through which his body projects. With this embodiment, the air exits primarily through openings formed at all four corners of the bed. These openings are formed between the side extensions 34 and the rear extension 36, and between the side extensions 34 and the front extension 38. As with the embodiment without the front extension 38, air also exits to lesser degree through the permeable lower fabric layer extensions 34, 36, and 38.

(h) The occupant of the bed creates the desired magnitude of the differential pressure, and thus the degree to which the blanket rises, primarily by using the controls 90 to adjust the speed of the blower. For the embodiment of the invention where the front extension 38 is not a part, the occupant also controls the magnitude of the differential pressure by selectively forming the front edge of the blanket 21 around his shoulders and neck. A looser fit around the shoulders and neck allows for a larger opening through which air can exit the cavity. Conversely, a tighter fit around the shoulders and neck creates a smaller opening through which air can exit the cavity. Generally, for a given air supply rate, the smaller the exit openings the higher the blanket will be elevated. The degree of elevation, of course, would be limited to the extent which the extensions to the lower fabric layer (34, 36, and 38) are tucked between the mattress and box springs. (It is noted that the shaded portion 25 of the upper fabric layer 24, being made of a blend of polyester and cotton, provides comfort to the occupant of the bed.)

(i) The occupant of the bed also operates the controls 90 to adjust the temperature of the air supplied to the blanket 20.

SUMMARY, RAMIFICATIONS, AND SCOPE

Thus the reader will see that the invention is unique in that a person in bed can recline in a controlled environment under a blanket 20 which is elevated solely as a result of differential air pressure. The environment created within the cavity 60 provides a realm of comfort thus far not realized by existing bed cover elevators or electric blankets. Air of controlled temperature is transported throughout a "built in" channel flow network 22. The network has a surface area approximately the same size as the surface area of the mattress. The natural weave of the lower fabric layer 32 is used as the means for air flow distribution from the network into the cavity. Each space between the threads which make up the weave of the lower fabric layer acts as a port for air flow. The result is a uniform and gentle distribution of air through thousands of tiny ports into the cavity. There are no orifices, slots, or holes in hollow frames or conduit which introduce air from isolated locations. The sensation of air movement is minimized, yet the cavity is constantly recharged with fresh air. The environment created is such that the entire body, including the head, can be comfortably contained within the cavity. Indeed, choosing to recline with the entire body within the cavity may well become the preferred method for using the blanket. On the other hand, many persons will likely prefer to have the blanket rest lightly on their bodies while gently supplying air of controlled temperature to the bed area.

The fact that the blanket can be used year-round adds another dimension to its appeal. There are no demands placed on the body to constantly adjust to ever-changing environments which come with the change in seasons. A sleeping pattern can be cultivated and maintained. It is likely that the number of restless nights will decrease, and better sleep will improve daily life.

The potential ramifications of the invention relative to medical applications are numerous. The invention could aid in the treatment of burn victims and persons with skin related diseases or abrasion. The invention would be useful in the field of orthopedic medicine for cases where even light weight on injured parts is painful. The implications of using the invention to assist in healing or minimizing respiratory problems are obvious. Though not specifically presented as an embodiment of the invention, a humidity controlling device could be between the blower and the blanket. Further, the blower discharge could be equipped with a method for injecting medicinal aerosols for the treatment of respiratory problems as well other medical problems. Certainly, many more medical applications for the invention will become apparent with the use of the invention. Undoubtedly, professionals in the field of medicine, as well as many "laymen", could immediately envision additional applications.

Aside from the obvious benefits of the invention relative to comfort and health, the invention requires very little effort or special knowledge for installation or operation. There are no frames to erect or connect to the bed, or upon which bed covers must be draped. Likewise, there are no structural supports to retract, dismantle, lower, remove, hide, or otherwise adjust when the bed is not in use. During installation the blanket is placed on the bed the same as most conventional bed spreads. The sie 34 and rear 36 extensions are tucked between the mattress and box springs. If the embodiment is used which includes the front extension 38, this extension is also tucked between the mattress and the box springs. The blower 80 is then connected to the entrance 49 to the primary air transport channel 40 by use of a coupling 84. A simple flip of switch places the blanket in operation. Access into the cavity is by working the zippers on either side of the blanket. Controls (90) for rate of air flow and air temperature are within easy access while reclining. When switched off, the blanket gently settles back onto the bed. Making the bed requires no more effort than that required where conventional blankets or spreads are used. Thus it is seen that the invention requires little effort or special knowledge or operation. It is simple enough for a child to operate.

While the preceding paragraphs contain many specificities, these should not be construed as limitations on the scope of the invention, but rather as exemplifications of a few preferred embodiment thereof. Many other variations which may not be apparent from the preceding discussion are possible. For example:

(a) The blanket can come in a variety of sizes and shapes to fit any size or shape of bed.

(b) The blanket fabrics can be of different materials from those previously presented. Coated nylons or nonconventional materials such as flexible mylar could be considered. Those experienced in the field of textiles could certainly determine numerous materials which would be suitable for the intended purpose of each of the fabrics layers.

(c) The air flow channel network can be of substantially different patterns from that shown. Diagonal and circular patterns can also be designed to provide the desired air flow characteristics.

(d) The blanket can be produced for use by two occupants with independent operation and controls for each side of the bed.

(e) Different methods for joining the fabric layers, such as heat bonding, could be used.

(f) The number of layers making up the blanket can be different from three.

(g) Different methods for holding the blanket in place can be developed. As an example, the outer edges of the upper fabric layer and/or the lower fabric layer extensions could be weighted to increase the downward force exerted on the blanket.

(h) Different methods for providing access into the cavity can be developed. As an example, Velcro (trademark name) could be used in place of zippers.

(i) Different methods for transfer of air from air-flow channel to another, or from the blanket to the cavity, can be developed. As one example, relatively impermeable fabric material with orifices (holes) could be substituted for porous fabric material, and vice versa. As another example, tubes made of plastic or some other material could be used for transport of air. Further orifices in said tubes could be used to transfer the air from the tubes to a space outside the tubes.

Accordingly, the scope of the invention should be determined not by the embodiment(s) illustrated, but by the appended claims and their legal equivalents.

I claim:

1. A bed covering system comprising a bed cover which can be elevated above a bed comprising a mattress and a box spring, thus creating a cavity between the bed cover and the bed, said cavity being formed as a result of higher air pressure within the cavity as compared to the air pressure outside the cavity, comprising:

(a) upper and lower fabric layers defining channels therebetween, said layers selectively connected together to form an air transportation and distribution network, wherein air is transported through the channels of said network and thence through the lower fabric layer, thus creating the higher air pressure under the bed cover as compared to the air pressure above the bed cover, the cavity being of a sufficient size to substantially enclose the user(s) of the cover, the lower fabric layer of the cover, having peripheral extensions adapted to be tucked between the mattress and the box spring supporting said mattress, the lower fabric layer including an opening closable by fastening means, said opening adapted to permit the user's entry into, and exit from the cavity, (b) an air blower, and (c) means for connecting said air transportation and distribution network to said blower.

* * * * *